United States Patent [19]

D'Angelo et al.

[11] Patent Number: 5,020,403

[45] Date of Patent: Jun. 4, 1991

[54] WEB FEEDING, CUTTING AND DISPENSING MACHINE

[76] Inventors: Joseph J. D'Angelo, 378 Annette Ct., Wycoff, N.J. 07481; Joseph J. D'Angelo, Jr., 2 Summit Ave., Pompton Lakes, N.J. 07442

[21] Appl. No.: 368,833

[22] Filed: Jun. 20, 1989

[51] Int. Cl.[5] ..... B26D 9/00

[52] U.S. Cl. ..... 83/171; 29/417; 83/236; 83/262; 83/282; 226/115

[58] Field of Search ..... 83/156, 171, 208, 221, 83/236, 261, 262, 282, 649; 226/115; 29/417

[56] References Cited

U.S. PATENT DOCUMENTS

| | | | |
|---|---|---|---|
| 4,151,770 | 5/1979 | D'Angelo et al. | 83/262 |
| 4,207,667 | 6/1980 | D'Angelo et al. | 83/262 X |
| 4,429,602 | 2/1984 | Vits | 83/261 X |
| 4,699,031 | 10/1987 | D'Angelo et al. | 83/261 X |

*Primary Examiner*—Timothy V. Eley
*Attorney, Agent, or Firm*—Parmelee, Bollinger & Bramblett

[57] ABSTRACT

A web feeding, cutting and dispensing machine includes a pneumatic cylinder for moving a hot wire to cut measured-length sheets from web stock. A pneumatic clamp cylinder moves a clamp bar for momentarily clamping the web during cutting. Upon pressing a start button, a pneumatic control valve sequentially operates the respective cutting and clamping cylinders for quickly retracting the hot wire, while more slowly retracting the clamp. Conversely, after the next measured web length has advanced, this control valve again sequentially operates these two cylinders in reverse order for quickly clamping while slower cutting. This dual control by one valve is advantageously achieved (1) by throttling air flow in retracting the clamp cylinder relative to retracting the cut cylinder, and conversely (2) by throttling air flow in advancing the cut cylinder relative to advancing the clamp cylinder. A compact machine has a hollow movable clamp bar torque member for equally driving both clamp arms by one clamp cylinder at one side of the machine. This movable clamp bar also serves as a passageway containing a torque shaft for equally driving both cutting arms by one cut cylinder at the other side. A "floating" upper feed roll accommodates different thicknesses of foam web without requiring adjustment and enables a lower feed roll to rotate continuously regardless of whether the web is clamped or not. Each cut sheet is conveniently held by a holder ready for use and is gently removable from the holder.

10 Claims, 4 Drawing Sheets

WEB FEEDING, CUTTING AND DISPENSING MACHINE

REFERENCES CITED

The following patents in the name of one or both of the present inventors relate to web feeding, cutting and dispensing machines which are more complex than the described machines embodying the present invention.

| Patent No. | Issue Date | Inventors |
|---|---|---|
| 4,151,770 | May 1, 1979 | Joseph J. D'Angelo<br>Lawrence S. Maccherone |
| 4,207,667 | June 17, 1980 | Joseph J. D'Angelo<br>Lawrence S. Maccherone |
| 4,699,031 | Oct. 13, 1987 | Joseph J. D'Angelo<br>Joseph J. D'Angelo, Jr. |

FIELD OF THE INVENTION

The present invention is in the field of machines for feeding web material and for cutting the web stock into sheets being dispensed. More particularly, this invention relates to machines for feeding, cutting and dispensing sheets of foam material, which are used for resiliently padding and packaging fragile articles, for example fruit, during shipment.

BACKGROUND

There are web feeding, cutting and dispensing machines as shown in the above-referenced patents. The present invention provides a machine performing those functions and which is compact and less complex than such prior machines.

SUMMARY

In the web feeding, cutting and dispensing machine embodying the present invention, a web of resilient foam material is fed from a roll of this web stock. A lower feed roll in continuous contact with the lower surface of the web is continually rotated while the machine is turned "ON". An upper "floating" feed roll is in continuous contact with the upper surface of the web in opposition to the continually rotating lower feed roll. This upper feed roll "floats" under its own weight, and it is tubular in construction intentionally to be light in weight. Thus, the frictional drive action on the web by the continuously rotating feed roll against the underside of the foam web is appropriately gravity-controlled and is slight, for thereby allowing the web to be clamped stationary for brief intervals while the lower feed roll continues rotating at its normal forward feed rate in contact with the clamped web without damage to the web.

A measuring wheel mechanism rides on the web and is pre-set to measure the desired lengths of web to be cut off for providing the cut sheets. A hot wire extending between a pair of movable arms serves to cut off the measured length, while a clamp bar supported by two movable arms stops the web during cutting. The two cutting arms are moved by a single pneumatic cylinder on one side of the compact machine, and the two clamp bar arms are also moved by a single pneumatic cylinder on the other side of this non-complex machine.

When a start button is pressed, a single solenoid-actuated air control valve advantageously serves to control both the cutting cylinder and the clamping cylinder for causing quick retraction of the hot wire and more slow retraction of the clamp bar. Then, after the desird length of web has been fed forward, this single solenoid valve again controls these two cylindrs for producing different rates of advancing strokes for quickly clamping while more slowly cutting.

This dual control action by a single solenoid valve is advantageously achieved (1) by throttling air flow to the retracting side of the clamp cylinder while allowing relatively unrestricted air flow to the retracting side of the cut cylinder for quickly withdrawing the hot wire away from its cutting position before the clamp bar is withdrawn from its clamp position, and (2) conversely by throttling air flow to the advancing side of the cut cylinder while allowing relatively unrestricted air flow to the advancing side of the clamp cylinder for quickly applying the clamp for stopping web motion before the hot wire moves upwardly through its cutting stroke for cutting the momentarily stopped web.

In order to provide a compact and non-complex machine, the clamp bar is hollow and takes the form of a stiff torque member interconnecting the two pivotally mounted clamp arms located on opposite sides of the machine, so that these clamp arms are caused to move equally. Thus, a single clamp cylinder located at one side of the machine is enabled to drive both clamp arms simultaneously equally. This hollow clamp bar advantageously serves as a passageway through which is extended a stiff torque shaft which interconnects the two cutting arms and serves as their pivot shaft, so that a single cut cylinder located at the opposite side of the machine from the clamp cylinder is enabled to drive both cutting arms simultaneously equally.

For conveniently holding each cut sheet at the front of the machine in position ready for use, there is a holder which is spring-biased toward closed position by a weak spring, so that a dispensed cut sheet can be pulled away from this holder while it remains biased toward its closed position After the user has used this sheet, the user presses the start button, and a small pneumatic cylinder overcomes the spring force and retracts the holder to allow the web to be fed forward out of the front of the machine in readiness for the next sheet to be cut. This holder cylinder releases the holder to be spring-biased closed as soon as the desired length of web has been fed forward prior to cutting.

BRIEF DESCRIPTION OF THE DRAWINGS

The invention, together with further aspects, objects, novel features and advantages thereof will be more clearly understood from a consideration of the following description taken in connection with the accompanying drawings which are arranged for clarity of illustration and not necessarily to scale, and in which like reference numerals are used to refer to corresponding elements throughout the various views.

FIG. 3 shows the machine enlarged relative to FIGS. 1 and 2.

FIG. 4 is drawn on the same scale as FIG. 3.

DETAILED DESCRIPTION OF PREFERRED EMBODIMENT

Figure 1:
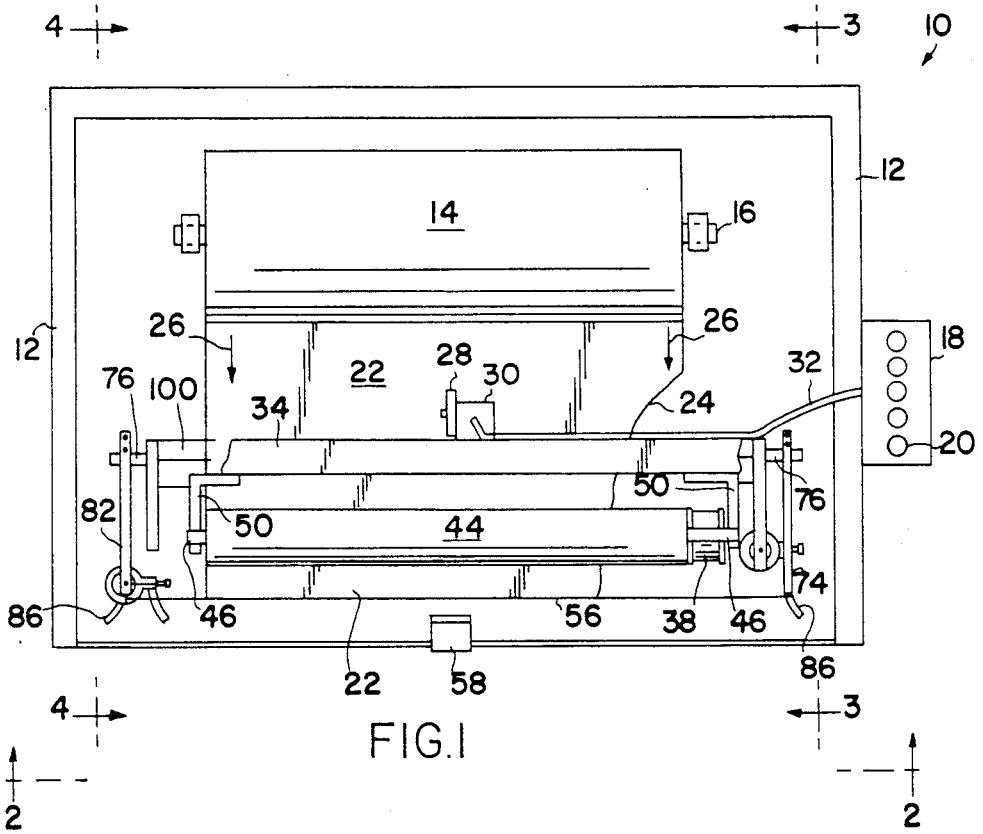
FIG. 1 is a top plan view of a web feeding, cutting and dispensing machine embodying the present invention. The machine top cover is removed in FIG. 1 and portions of a transverse frame member are shown broken away at each end for more clearly revealing machine components.
Figure 2:
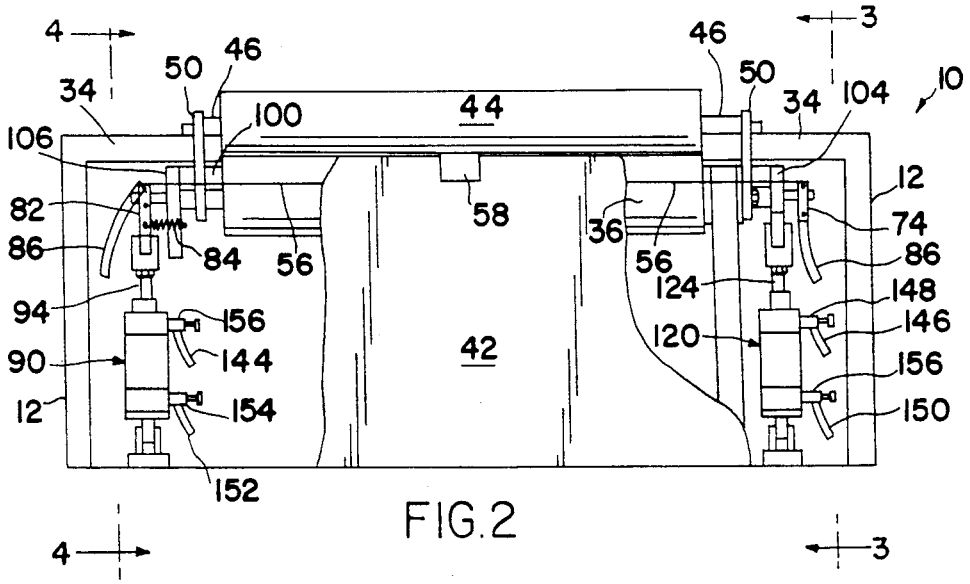
FIG. 2 is a front elevational view of the machine as seen looking at FIG. 1 from the position 2—2, with the top cover removed. Portions of a front panel of the machine are shown broken away at each side for more clarly revealing machine components.

As shown in FIGS. 1 and 2, a web feeding, cutting and dispensing machine 10 embodying the present invention comprises a frame 12 with a web stock source roll 14 mounted for free rotation about a support shaft 16 locatd near the rear of the machine and carried by the machine frame 12. This illustrative example shows a roll 14 of resilient foam padding and packaging material about one-eighth of an inch thick but thinner or thicker material can readily be handled in the same manner as the web 22 to be described. In FIG. 1, a web 22 of the foam material is seen being led forward through machine. For clarity of illustration, a portion of this web 22 is shown as having been torn away in the region 24 in FIG. 1. Arrows 26 near each margin of the web 22 indicate the forward direction of web travel through the machine.

A controller 18 at the right of the machine includes a switch for turning the machine "ON" or "OFF" and signal means to indicate that the machine is ready for operation. There is a start button 20 which is pressed each time that the operator desires that another sheet be dispensed from the web 22.

In order to measure the length of web 22 which is being fed forward through the machine 10, there is a measuring wheel 28 in rolling contact with the upper surface of this web of foam stock. This rolling measuring wheel 26 actuates a length counter 30 connected to the control system 18 by an electrical cable 32, and the desired length for each sheet to be dispensed is pre-settable. Such a pre-settable rolling wheel length counter is known in the art.

The length counter 28 is mounted on a transverse brace member 34 which is a rigidly fixed component of the machine frame 12. The end portions of this transverse frame member are shown broken away in FIG. 1 for clarity of illustration. This fixed transverse frame member 34 also serves as a stationary anvil in the web clamping apparatus described later.

Figure 3:
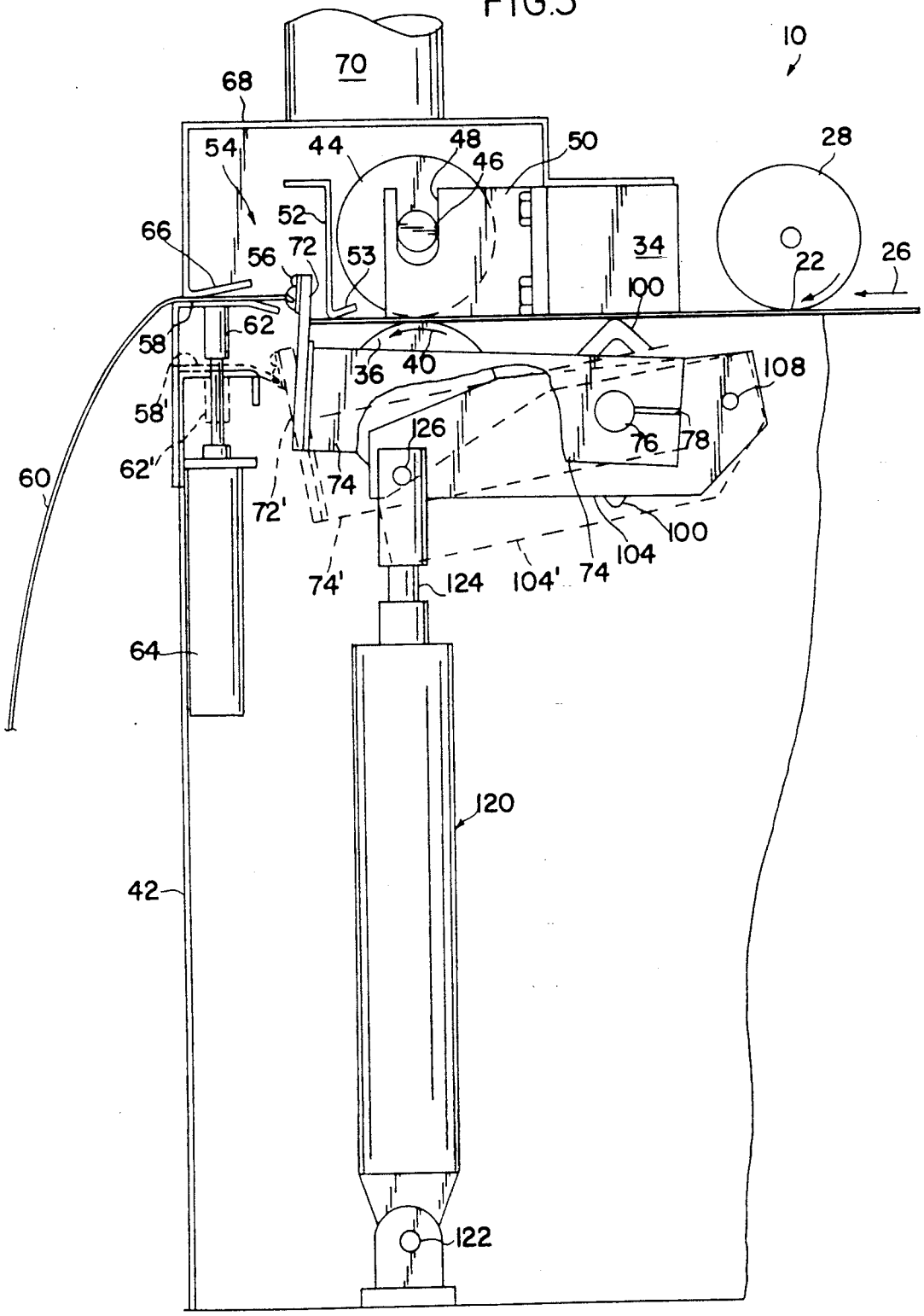
FIG. 3 is a sectional elevational view taken along the lines 3—3 in FIGS. 1 and 2 near the right side of the machine.
Figure 4:
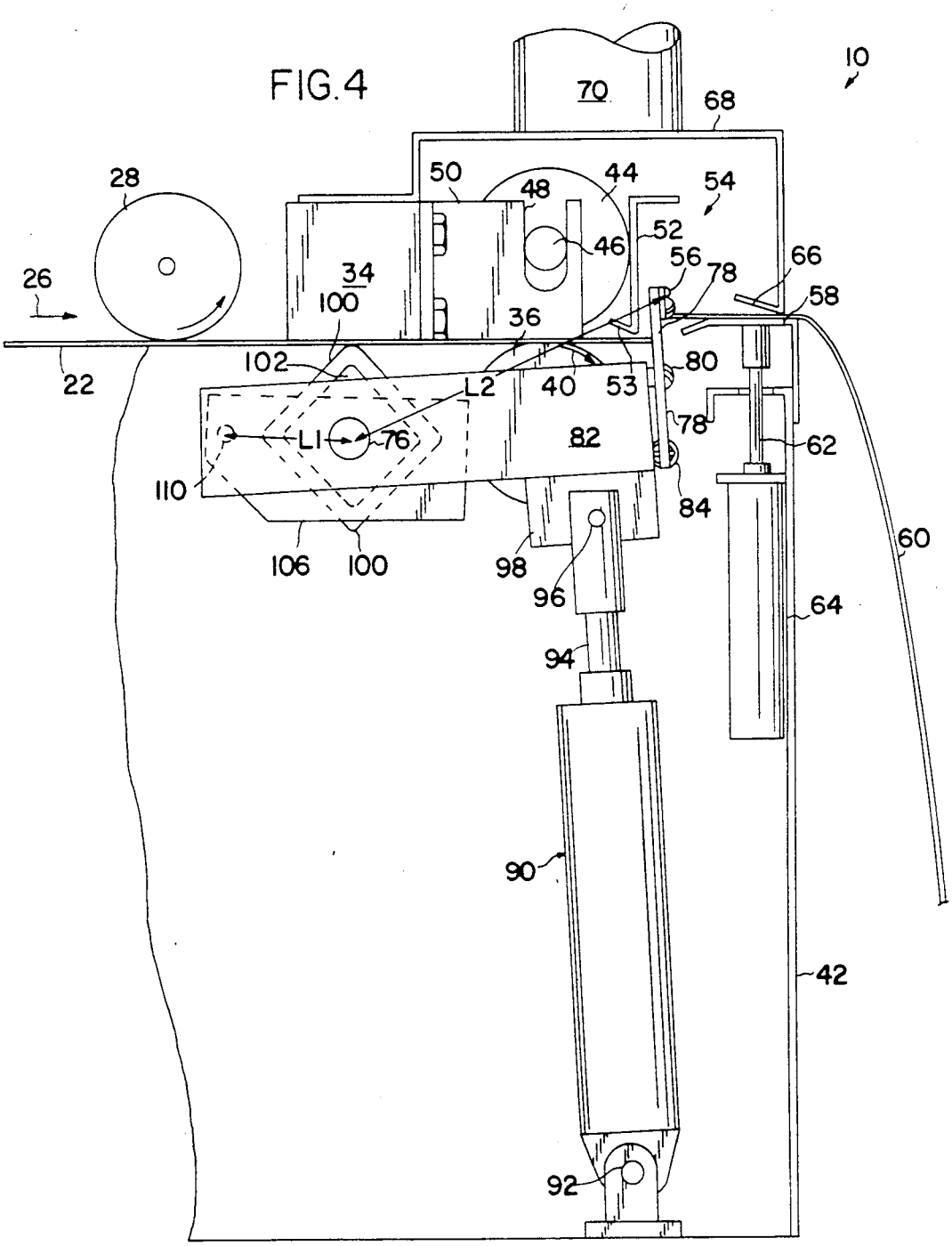
FIG. 4 is a sectional elevational view taken along the lines 4–4 in FIGS. 1 and 2, near the left side of the machine

In order to feed the web 22, there is a lower feed roll 36 (FIG. 2) which is rotated about a stationary axis by a drive belt 38 (FIG. 2) driven by a motor unit (not shown) located behind a front panel 42 of the machine. Side portions of this front panel 42 are shown broken away in FIG. 2 to reveal the operating components. This lower feed roll 36 is also seen in FIGS. 3 and 4. As long as the machine 10 is turned "ON", this lower feed roll 36 is continually rotated at its normal forward feed rae as shown by the arrows 40. For keeping the web 22 lightly in continuous contact with the continually rotating lower feed roll 36, there is an upper roll 44 which is in continuous contact with the upper surface of the web 22. This upper feed roll 44 "floats" under its own weight. It intentionally is made in a tubular, hollow, light-weight construction and has an axial shaft 46 projecting at both ends freely riding in vertical slots 48 in a brackets 50 fixed to the transverse frame member 3.

There are bearings within each end of the tubular upper feed roll 44 for providing free rotation of this roll about its axial shaft 46. As seen in FIGS. 3 and 4, these vertical slots 48 are sufficiently deep for allowing the light-weight upper roll 44 to be in "floating" contact with the web 22, with the upper roll 44 directly opposite to the lower roll 36. This lower drive feed roll 36 is larger in diameter than upper roll 44.

As seen in FIGS. 3 and 4, the web 22 travels forward beneath the transverse frame member 34 and forward between the feed rolls 36 and 44, and forward beneath a shield 52 which separates and shields the upper feed roll 44 from a cutting station 54 in which a hot wire 56 cuts off each dispensed sheet 60 of the resilient foam padding and packaging material. An inturned, upturned lip 53 on this shield 52 guides the web and serves to keep the web from deflecting upwardly during each upward cutting stroke of the hot wire 56.

The dispensed sheet 60 is seen hanging forwardly from the front of the machine being temporarily conveniently held by a holder 58 in readiness for manual removal by the operator. This movable holder 58 is spring-biased toward its holding position by a weak spring, so that the cut sheet 60 can redily be taken away with a quick easy pull by the operator.

This cut sheet holder 58 is moved up and down by a piston rod 62 extending vertically from the upper end of a holder cylinder 64 mounted on the front panel 42. A spring (not seen) inside of the holder cylinder 64 biases the piston rod 62 to its upper (holding) position. Each time that the operator presses the start button 20 to obtain another cut sheet 60, air is fed into the upper end of the holder cylinder 64, overcoming the weak spring force and retracting the holder 58 to its open position, as shown in dashed outline 58', 62' in FIG. 3. Above the holder 58, there is an inturned upwardly sloping lip 66 of a top cover 68. The holder 58 removably holds each cut sheet 60 by lightly clamping the cut sheet up against the stationary lip 66 of the cover 68. A vent duct 70 connected to this top cover 68 carries away any fumes generated by the action of the hot wire 56 in cutting the web 22. In FIGS. 1 and 2, this top cover 68 and vent 70 have been removed for clearly showing the working components being described with reference to those FIGURES.

In order to support and move the hot cutting wire 56, its right end (FIG. 3) is mounted on an insulated bracket 72 secured to the front end of a right cutting arm 74, which is swingably carried by a cutter arm pivot and drive shaft 76. A portion of this right cutting arm 76 is shown broken away in FIG. 3 for clarity of illustration. For adjusting the position of this right cutting arm 74 on its shaft 76, the rear end of this arm 74 is slotted at 78, and there is a clamp screw (not seen) for fixedly securing this slotted arm onto its shaft 76.

In FIG. 3, the hot cutting wire 56, its insulated bracket 72, and right cutting arm 74 are shown by full lines in their upper position, which they occupy after completion of an upward cutting stroke. The retracted or withdrawn lower position of the insulated bracket 72 and right cutting arm 74 are shown in dashed outline at 72' and 74'.

The left end of the hot cutter wire 56 is mounted on an insulated bracket 78 (FIG. 4) carried by a pivot 80 mounted on a left cutting arm 82 secured to the cutting arm pivot drive shaft 76. (It will now be understood that the right cutting arm 74 [FIG. 3] is adjusted by its clamp slot 78 to be clamped onto shaft 76 in parallel relation with the left arm 82 which is secured to this same shaft 76). Turning attention back to the pivotally mounted hot wire support bracket 78, a tension spring 84 pulls on this pivoted bracket for keeping the hot wire 56 taut to prevent sagging. This wire 56 is a high resistance conductor and is heated by a low voltage, high amperage current fed by insulated conductors 86 (FIG. 2) from a voltage step-down transformer (not shown).

The use of a hot wire for cutting foam material is known in the art, but the present compact cutting arm pivot support and drive system is novel as will be explained. There is only a single pneumatic cut drive cylinder 90 (FIG. 4) for swinging both the left and right cutting arms 82 and 74. This cut drive cylinder 90 is at the left side of the machine, being pivotally connected at 92 to the machine frame 12 and having its piston rod 94 pivotally connected at 96 to a tab 98 secured to the left cutting arm 82.

It is to be noted that the cutting arm pivot and drive shaft 76 has a relatively large diameter, and it is a solid shaft, for example of steel, thereby being very stiff for resisting torsional deflection. In effect, this shaft 76 is a stiff torque shaft which ties the left and right cutting arms 82 and 74 together, so that they will swing equally simultaneously when the cut drive cylinder 90 drives the left cutting arm 82 up during a cutting stroke and down during a retraction stroke. This cutter arm pivot and drive shaft 76 is rotatably supported by a pair of bearings located in opposite ends of a movable hollow clamp bar 100 having a square tubular cross-sectional shape as shown by dashed lines in FIG. 4.

In a novel compact configuration, this cutter arm pivot and drive shaft 76 extends transversely across the machine through a passageway 102 defined by the hollow interior of the movable square tubular clamp bar 100, and bearings for shaft 76 are located within opposite ends of this same hollow movable clamp bar, such that a single cut cylinder 90 can simultaneously equally swing both cutting arms located on opposite sides of the machine. The movement of the hollow clamp bar 100 between its upper clamping position and lower retracted position and the clamp arm length are sufficiently small that the operation of the cutting wire 56 is not adversely affected by the fact that the bearings for the pivot shaft 76 are mounted within a movable clamp bar. Moreover, the length "L1" (FIG. 4) of the clamp arms 104, 106 between the clamp arm pivot axis as defined by fixed pivots 108, 110 and the axis of the cut arm pivot and drive shaft 76 is only about 35 percent of the length "L2" of the cut arms 74, 82 between the axis of their pivot and drive shaft 76 and the hot wire 56. Since L1 is less than 50% of L2, the actual cutting position of the wire 56 is insignificantly changed relative to the fixed web guide support 53, regardless of whether the clamp bar 100 is up or down.

This clamp bar 100 is shown in its upper (web-clamping) position in FIGS. 3 and 4 whereby the web 22 is clamped by a rounded corner of this bar up against the stationary machine frame member 34. Thus, the web 22 is held stationary momentarily in spite of continuing rotation 40 of the lower feed drive roll 36, while the hot wire 56 is swung up in its upward cutting stroke for cutting off a sheet 60 from the now stationary web.

The clamp bar 100 has a square configuration with rounded corners and is attached (with one rounded corner facing upwardly) to and is supported by left and right clamp arms 104 (FIG. 3) and 106 (FIG. 4) which are pivotally mounted to the machine frame by a respective left pivot 108 and a right pivot 110, which are aligned with each other to define the fixed pivot axis for the clamp arms.

The hollow clamp bar 100 has a relatively large effective diameter by being a hollow square tubular member, and thus it also is very stiff for resisting torsional deflection In effect, this clamp bar 100 is also a stiff torque shaft which ties the left and right clamp arms 104 and 106 together, so that they will swing equally simultaneously when a single clamp drive cylinder 120 located at the right side of the machine swings both arms up into clamp position for stopping the web 22 or retracts both arms down into a withdrawn position for releasing the web 22. The web is released whenever the operator calls for dispensing of another cut piece by pressing the start button 20.

The clamp drive cylinder 120 is pivotally mounted at 122 to the machine frame and has a piston rod 124 pivotally connected at 126 to the left clamp arm 104. In FIG. 3 the left clamp arm 104 is shown retracted in dashed outline at 104' in its withdrawn non-clamping position.

Figure 5:
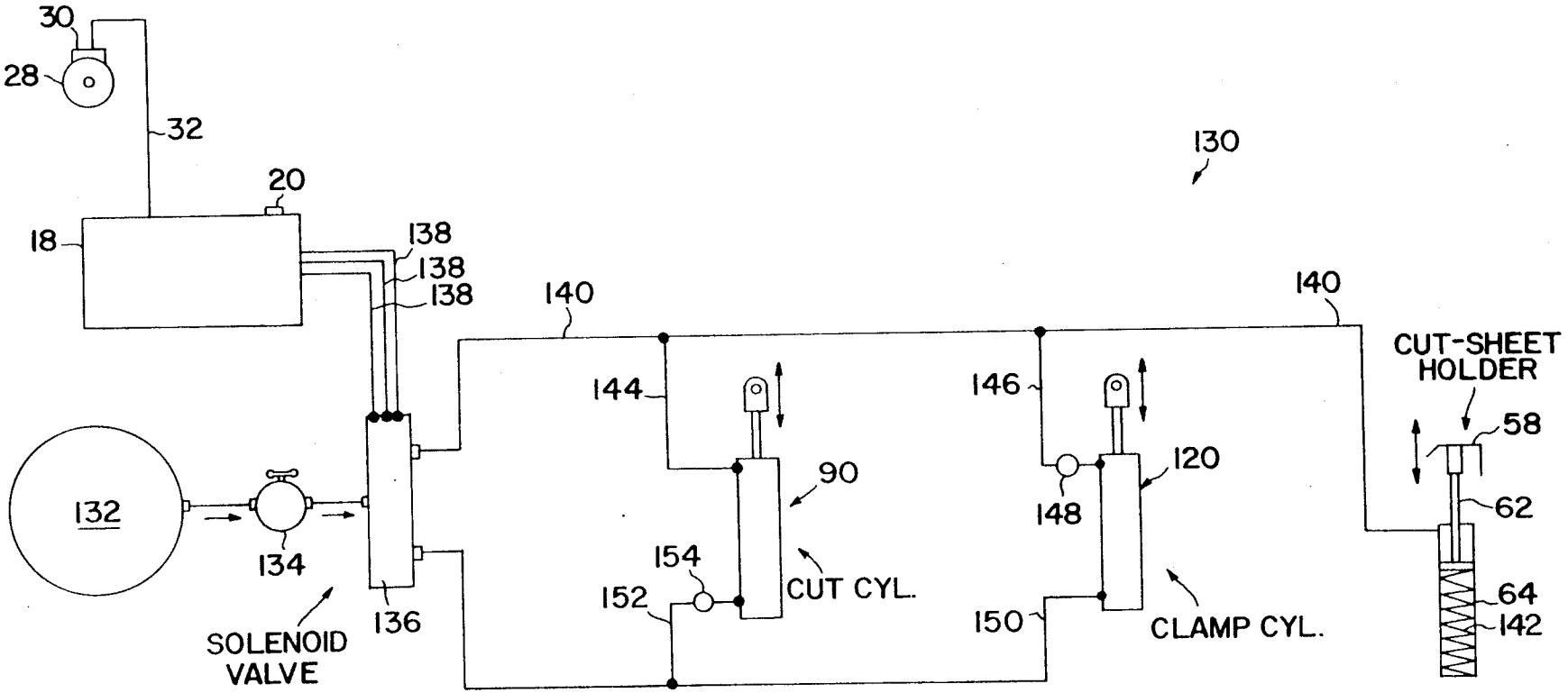
FIG. 5 is a schematic diagram of the pneumatic system of the machine as controlled by a single solenoid-actuated air control valve.

In FIG. 5 is shown the pneumatic control system 130 for the machine 10. In this system 130, comprssed air is supplied from a "shop air" source 132, for example at a pressure in the range from 60 pounds per square inch (psi) to 130 psi. A pressure regulator 134 is used to set and regulate the pressure of air furnished to a solenoid-actuated air control valve 136 which is controlled through electrical connections 138 from the controller 18.

As explained earlier, when the start button 20 is pressed, the solenoid valve 136 is actuated into a first position to feed unrestricted air through a line 140 to the retraction end of the holder cylinder 64, thereby retracting the holder 58 against the force of a spring 142 which biases upwardly the holder piston rod 62. Thus, the holder 58 moves down out of the way of the sheet which will be dispensed.

Also, when in its first position, the solenoid valve 136 feeds relatively unrestricted air through a line 144 to the retraction end of the cut cylinder 90 for quick retraction of the hot wire. In distinction, the air flow to the retraction end of the clamp cylinder 120 is more slowly fed through a line 146 including a restriction (throttling) valve 148. Thus, the cutting wire is retracted out of the way quickly by the cut cylinder 90 before the clamp cylinder 120 more slowly acts to withdraw the clamp bar to allow the continually rotating feed roller to feed forward the web in readiness for the next sheet to be cut off.

When the length measure counter 28, 30 has reached the desired pre-set length for the cut sheet, controller 18 causes the solenoid valve 136 to move into a second position to supply relatively unrestricted air through a line 150 to the advancing end of the clamp cylinder 120 for quickly clamping the web and air is released from the line 140, so that the holder spring 142 causes the holder 58 to hold the sheet which will be cut off. In distinction to fast flow through line 150, the air flow to the advancement end of the cut cylinder 90 is more slowly fed through a line 152 including a restriction (throttling valve) 154. Thus, the cutting wire is not moved upwardly in its cutting stroke until after the web has been clamped stationary by the clamp cylinder 120 and after the holder 58 is already holding the about-to-be-cut sheet 60.

In FIG. 2 are seen the throttling valves 154 and 148 for the cut cylinder 90 and the clamp cylinder 120. It is noted that flow control valves such as 156 (FIG. 2) may also be included to balance the system, but flow through lines 144 and 150 is relatively unrestricted relative to flow through lines 146 and 152, respectively.

While the novel features of the invention have been illustrated and described in connection with a specific embodiment of the invention, it is believed that this embodiment will enable others skilled in the art to apply the principles of the invention in forms departing from the exemplary embodiment herein, and such departures are contemplated by the claims.

We claim:

1. A web feeding cutting and dispensing machine having a frame with back, front and left and right sides, said machine being capable of being turned "ON" comprising:

roll support means for supporting a roll of a web for supplying the web to be fed in a downstream direction along a predetermined path for exiting from the front of the machine, a first rotatable feed roll positioned adjacent to said path for continually contracting the web, drive means coupled to said first feed roll continually rotating said first feed roll in contact with the web for applying to the web a continual force urging the web in said downstream direction along said path for causing an end of the web to exit from the front of the machine, feed means on an opposite side of said web from said first feed roll and in position opposed to said first feed roll for keeping the web in contact with said continually rotating first feed roll, clamp means positioned along said path upstream from said first feed roll, said clamp means being movable to a clamping position for clamping the web for holding the web stationary in spite of said continual force resulting from continual rotation of said first feed roll, said clamp means also being movable to a release position for allowing the web to move in said downstream direction along said path in response to said continual force, a pneumatic clamp cylinder connected to said clamp means for moving said clamp means into said clamping and releasing positions, said pneumatic clamp cylinder having two ends into which air flow can be fed, one end being a clamping end for air flow into said clamping end moving said clamp means into said clamping position, and the other end being a releasing end for air flow into said releasing end moving said clamp means into said releasing position, cut means positioned along said path downstream from said first feed roll, said cut means being movable in a cutting stroke passing through said path for cutting off from the web a portion of the web including its end which has exited from the front of the machine for dispensing a cut sheet from the front of the machine, said cut means also being movable in a retraction stroke for clearing the path while the web is being fed downstream, a pneumatic cut cylinder connected to said cut means for moving said cut means in said cutting stroke and in said retraction stroke, said pneumatic cut cylinder having two ends into which air flow can be fed, one end being a cutting end for air flow into said cutting end moving said cutting means in said cutting stroke, and the other end being a retraction end for air flow into said retraction end moving said cutting means in said retraction stroke, a pneumatic control system including solenoid-actuated valve means having a first condition for feeding air flow to said clamping end and cutting end and having a second condition for feeding air flow to said releasing end and retraction end, throttling means associated with said cutting end of said cut cylinder for relatively throttling air flow to said cutting end in relation to relatively freer air flow to said clamping end of the clamp cylinder for causing the clamp cylinder to move said clamp means into its clamping position for clamping the web for holding the web stationary before the cut cylinder moves the cut means in its cutting stroke for cutting off a cut sheet from the web, and throttling means associated with said releasing end of said clamp cylinder for relatively throttling air flow to said releasing end in relation to relatively freer air flow to said retraction end of said cut cylinder for causing the cut cylinder to move said cut means in its retraction stroke before the clamp cylinder moves the clamp means into its releasing position for allowing the web to be fed downstream by said continually rotating lower feed roll.

2. A web feeding and cutting machine as claimed in claim 1, in which:

said clamp means includes a left clamp arm near the left side of the machine mounted by a left pivot in fixed position relative to the frame and a right clamp arm near the right side of the machine mounted by a right pivot aligned with said left pivot and in fixed position relative to the frame, said clamp means also includes a rigid hollow bar extending between and fixed to said left and right arms, and said clamp cylinder being mounted near a side of the machine and having a piston rod connected to one of said clamp arms for simultaneously moving both of said clamp arms.

3. A web feeding cutting and dispensing machine as claimed in claim 2, in which:

said cut means includes a left cut arm nearer the left side of the machine than said left clamp arm and a right cut arm nearer the right side of the machine than said right clamp arm, a rigid pivot shaft extending between and being secured to said left and right cut arms for pivotally mounting said left and right cut arms, and said pivot shaft for said cut arms extending through said hollow clamp bar of said clamp means

4. A web feeding, cutting and dispensing machine as claimed in claim 3, in which:

said pivot shaft for said cut arms has an axis of rotation and is bearing mounted for rotation about said axis of rotation within said hollow clamp bar.

5. A web feeding, cutting and dispensing machine as claimed in claim 4, in which:

said cut means includes a hot wire for cutting the web, said hot wire is mounted on and extends between said left and right cut arms, and the distance L1 from a clamp arm pivot axis defined by said aligned left and right pivots of the respective clamp arms to the axis of rotation of said cut arms is less than 50% of the distance L2 from said axis of rotation to said hot wire.

6. A web feeding, cutting and dispensing machine as claimed in claim 3, in which:

said cut cylinder is mounted near a side of the machine and has a piston rod pivotally connected to one of said cut arms for simultaneously moving both of said cut arms due to their rigid pivot shaft which holds said cut arms substantially parallel with each other.

7. A web feeding, cutting and dispensing machine as claimed in claim 6, in which:

said cut cylinder and said clamp cylinder are mounted near opposite sides of the machine.

8. A web feeding, cutting and dispensing machine as claimed in claim 1, in which:

said feed means is an upper feed roll positioned above the web, said upper feed roll is aligned above said first feed roll, said first feed roll is a lower feed roll below the web, said upper feed roll is movable up and down and is biased by gravity against an upper surface of said web for holding the web in continuous contact with the continually rotating lower feed roll, and said upper feed roll is hollow and light in weight for only lightly holding the web in continuous contact with the lower feed roll for allowing the lower feed roll to be continually rotating while the web is clamped stationary for avoiding damage to the stationary web by the continually rotating lower feed roll in contact with the web.

9. A web feeding, cutting and dispensing machine as claimed in claim 1, further comprising:

holder means positioned near the front of the machine, said holder means is positioned near said predetermined path, said holder means includes a movable holder element, a holder cylinder is mounted to the frame and has a piston rod connected to said holder element, said holder element is movable to said path for holding said portion of the web prior to its being cut off from the web and said holder element is withdrawable away from the path for clearing the path, spring means urges said holder element to said path for holding said portion of the web, said holder cylinder has a withdrawal end to overcome said spring means for withdrawal of said piston rod and holder element, and said pneumatic control system is connected to said withdrawal end of said holder cylinder for said solenoid-actuated valve in said second condition to feed air flow into said withdrawal end for withdrawing said holder element to clear the path before said clamp means releases the web.

10. A web feeding, cutting and dispensing machine as claimed in claim 9, in which:

said spring means are weak for allowing an operator of the machine to pull a cut sheet away from said holder means by a quick, gentle pull.

* * * * *